US010159329B1

(12) United States Patent
Lang et al.

(10) Patent No.: US 10,159,329 B1
(45) Date of Patent: Dec. 25, 2018

(54) SIDE ARM

(71) Applicant: Anthony J. Lang, Quincy, CA (US)

(72) Inventors: Anthony J. Lang, Quincy, CA (US); Richard Lee Lang, Orland, CA (US); Renaldo Nicholas Herrera, Paradise, CA (US)

(73) Assignee: Anthony J. Lang, Quincy, CA (US)

( * ) Notice: Subject to any disclaimer, the term of this patent is extended or adjusted under 35 U.S.C. 154(b) by 198 days.

(21) Appl. No.: 15/278,415

(22) Filed: Sep. 28, 2016

(51) Int. Cl.
*A45F 5/02* (2006.01)

(52) U.S. Cl.
CPC ..... *A45F 5/021* (2013.01)

(58) Field of Classification Search
CPC ..... F16M 11/40; A45F 5/021
USPC .... 224/185, 195, 660, 662–663, 254, 42.34; 248/276.1, 335, 160; 403/56
See application file for complete search history.

(56) References Cited

U.S. PATENT DOCUMENTS 6,007,486 A * 12/1999 Hunt ..... A61B 17/02 600/201
7,641,162 B2 * 1/2010 Tsay ..... F16M 11/043 248/284.1
2008/0251662 A1 * 10/2008 Desorbo ..... F16M 11/14 248/178.1
2014/0342785 A1 * 11/2014 Saldo ..... H04M 1/04 455/575.6
2015/0223590 A1 * 8/2015 Arias-Tabima ..... A45F 5/021 224/195
2015/0362824 A1 * 12/2015 Cunningham, III ... F16M 13/04 396/423
2016/0066679 A1 * 3/2016 Capps ..... A45F 5/02 224/660
2016/0182698 A1 * 6/2016 Gordon ..... H04M 1/04 455/575.6
2017/0156480 A1 * 6/2017 Botticello ..... A45F 5/021

* cited by examiner

*Primary Examiner* — Scott McNurlen
(74) *Attorney, Agent, or Firm* — William Bodnar

(57) ABSTRACT

Embodiments of the present invention provide a new and improved hands-free mounting apparatus that has at least three rotational degrees of freedom. The apparatus includes a waist belt worn by a user and utilizes a cable and first and second cable housings. Tubular arm segments are positioned between the first and second cable housing assembly. A pivot lock arm allows the user to adjust the position of various components and lock those components and attached device in a fixed position. Other embodiments provide another two rotational degrees of freedom.

12 Claims, 10 Drawing Sheets

SIDE ARM

CROSS REFERENCE TO RELATED APPLICATIONS

None.

FIELD OF THE INVENTION

The present invention relates to a unique mounting apparatus that is attached to a waist belt and allows hands-free access to a device mounted thereupon.

BACKGROUND OF THE INVENTION

The apparatus disclosed herein provides solutions to problems inherent in the related art. Devices in the related art have failed to provide the necessary support for mechanisms and their attachments when the mechanisms are in the stored and deployed positions. An object of embodiments of the present invention is to provide an apparatus that can support itself and its attachments on a user when the apparatus is deployed for use in a variety of orientations or placed in a stored position.

SUMMARY OF EMBODIMENTS OF THE INVENTION

Embodiments of the present invention provide a new and improved hands-free mounting apparatus that has at least three rotational degrees of freedom. The apparatus includes a waist belt worn by a user and utilizes a cable and first and second cable housings. Tubular arm segments are positioned between the first and second cable housing assembly. A cam lock arm allows the user to adjust the position of various components and lock those components and any attached device in a fixed position. A pivot support assembly is also utilized for further positioning.

All embodiments utilize a unique tubular base segment that is rigid and has both a curved section and a straight section. The tubular base segment can be rotated 360 degrees about an axis A1 (through the first cable housing assembly) and allows for both accurate and efficient placement of the position of the tubular base and attached components/device(s). At least one tubular arm segment can rotate about an axis A2 that runs through the center of the straight section of the tubular base segment. A pivot support assembly can be rotated about an axis A3 that is coincident with a pin shaft through the assembly.

Other embodiments provide another two rotational degrees of freedom. In an embodiment with a tubular end segment, the tubular end segment can be rotated approximately 30 degrees off of axis A4, the axis coincident with center of the adjacent tubular arm component. In another embodiment, a device that is attached to the apparatus can be further rotated about axis A5, the axis coincident with the center of the pivot support assembly.

BRIEF DESCRIPTION OF DRAWINGS

The invention is illustrated in the following drawings.

FIG. 14 is an isometric view of mounting posts 88 of mounting plate 86 as aligned with corresponding slots in base 96.

FIG. 15 is an isometric view of mounting plate 86 and base 96, shown partially assembled.

FIG. 16 is a detail section plan view taken from FIG. 15, without the hook portion of post 88, showing the interlocking detent features of a post 88 and a slot in base 96.

FIG. 17 is an isometric view of mounting plate 86 and base 96, shown fully assembled.

FIG. 18 is an elevation section view, taken from FIG. 16, showing post 88 detachably engaged with plate 86.

DETAILED DESCRIPTION OF AN ENABLING EMBODIMENT

Figure 1:
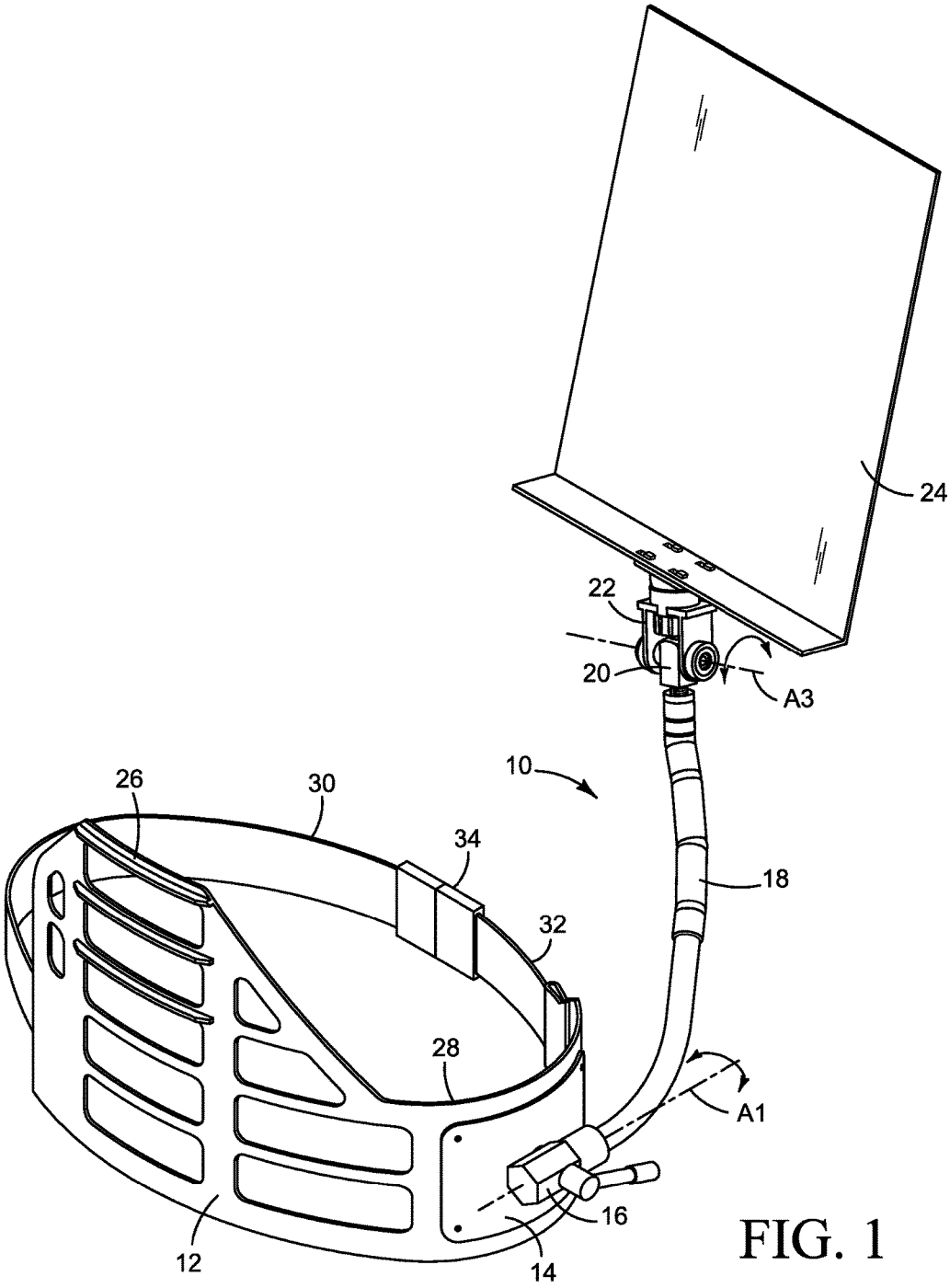
FIG. 1 is an isometric view of an embodiment of the invention with an exemplary attachment.

As shown by an embodiment of the invention in FIG. 1, the hands-free device mounting arm apparatus 10 includes a waist belt 12 with a mounting plate 14 attached thereto. A first cable housing assembly 16 is secured to the waist belt at the mounting plate. An adjustable, tubular arm 18 houses a cable and is attached to the first cable housing assembly 16 at one end and a second cable housing assembly 20 at the other end. A pivot support assembly 22 is connected to the second cable housing assembly and acts as a base for a device 24 attached thereto.

The waist belt 12 has a tall, rear center support section 26 and at least one side support section 28. Two end sections 30, 32 can be connected through an attachment mechanism 34 to create the front section of the belt. The center support section 26 and the side support section 28 are rigid to counter the weight of the tubular arm 18 and attached device 24. The combination of the high center section 26, the support side section 28 and the support plate 14 provide a unique combination that not only supports but also helps to balance the forces applied by the arm and attached device.

Figure 2:
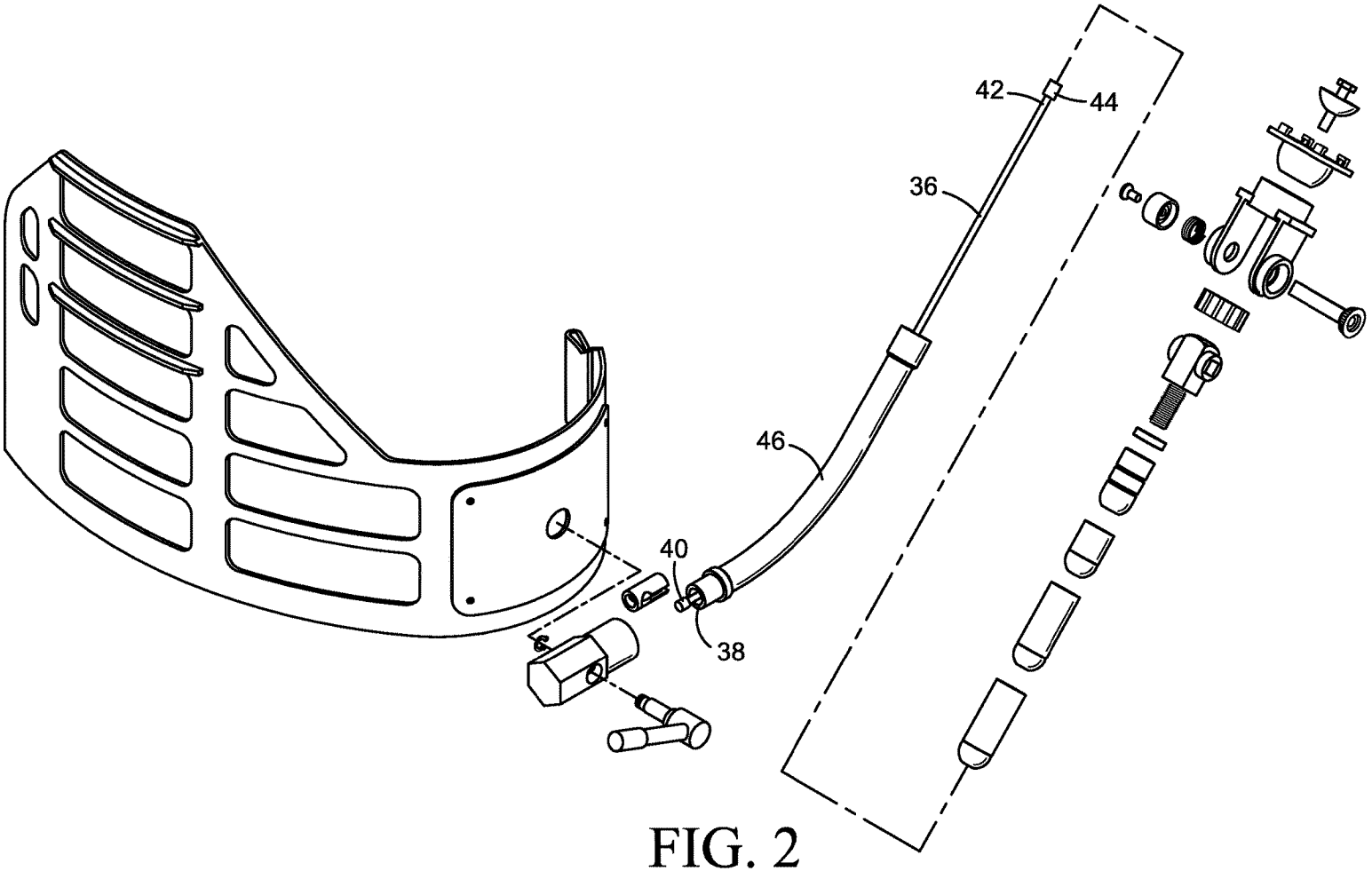
FIG. 2 is an exploded isometric view showing all components of an embodiment of the invention.
Figure 3:
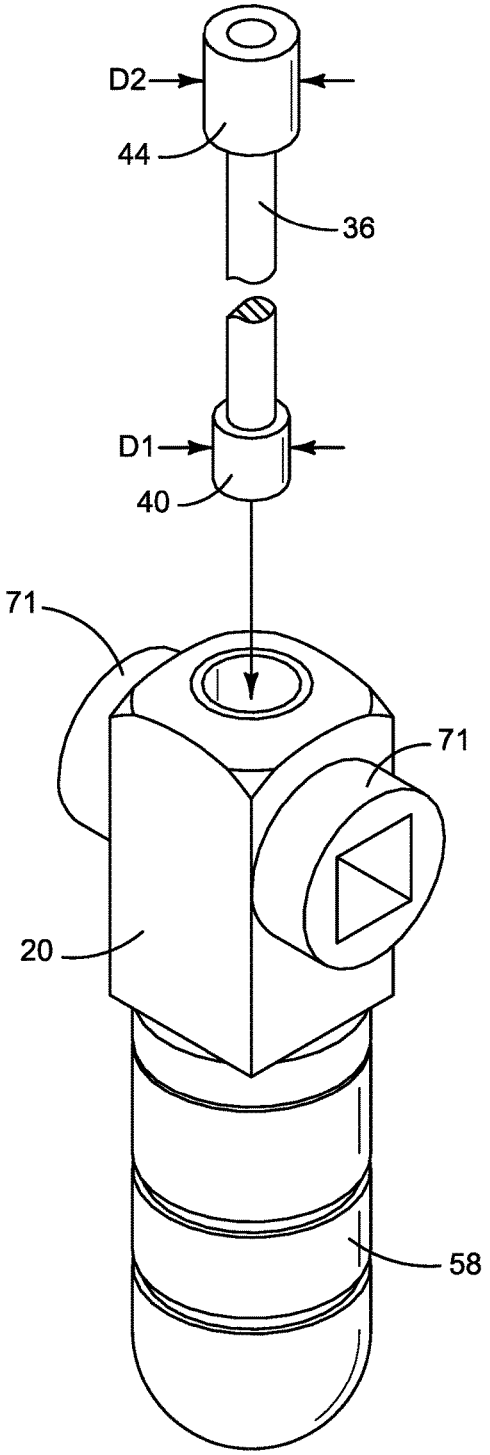
FIG. 3 is a perspective view showing the upper (second) cable housing and cable assembly.
Figure 4:
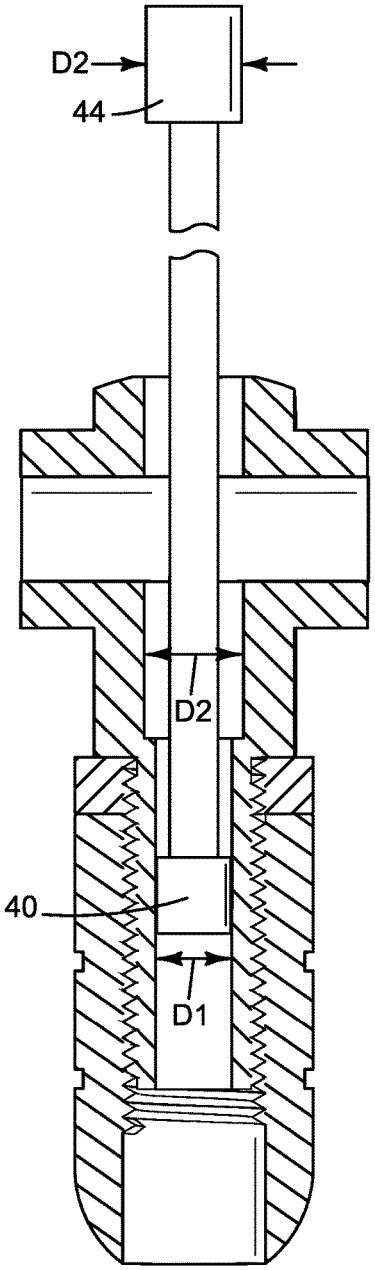
FIG. 4 shows a detail section of the upper (second) cable housing and cable assembly.
Figure 5:
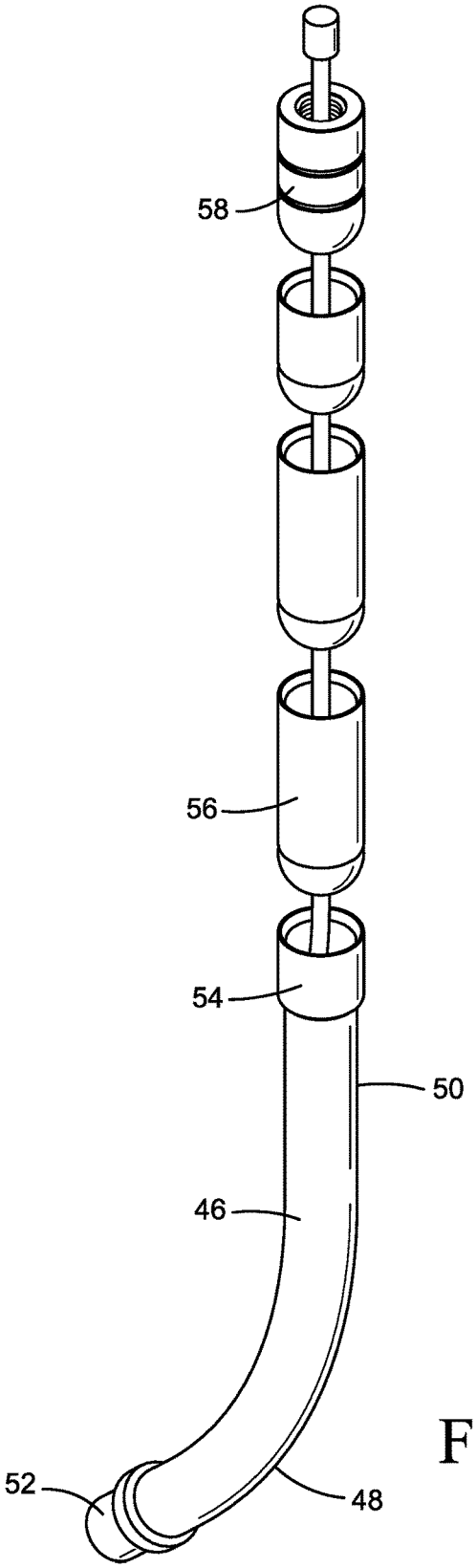
FIG. 5 is a perspective view of cable installation through the tubular arm sections.
Figure 7:
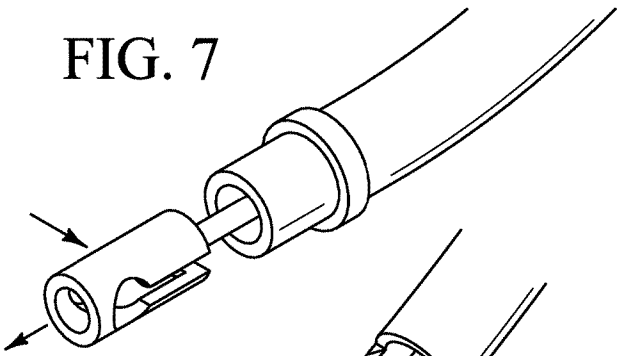
FIG. 7 is a perspective showing a cable end inserted into the cable retention sleeve.
Figure 6:
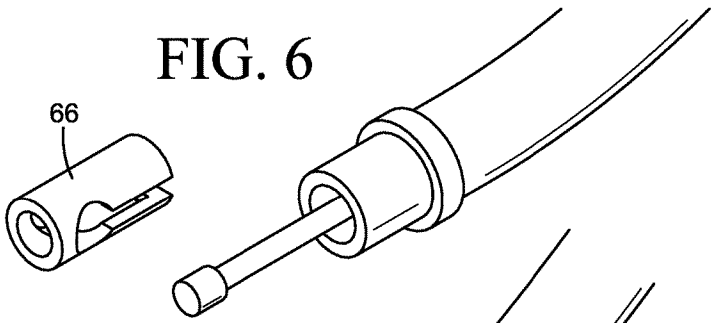
FIG. 6 is a perspective showing the cable fully inserted into the rigid section of the tubular arm.

The majority of the apparatus components are shown in an exploded view in FIG. 2. The cable 36 has a first end 38 and a first bead stop 40 and a second end 42 and a second bead stop 44. A rigid tubular section 46 provides the base of the tubular arm as is connected at one end to the first cable housing assembly. Referring to FIGS. 3-10, the tubular base 46 contains a curved section 48 and a straight section 50. A flange ring 52 fits into an opening in the first cable housing assembly to connect the tubular arm to the assembly. A flared end 54 is utilized to connect the top of the tubular arm to an adjustable tubular arm segment 56. A plurality of tubular arm segments 56 may be used as necessary. A tubular end segment 58 provides the connection for the tubular arm to the second cable housing assembly 20.

To begin assembling the components, a user could feed first bead stop 40 (and first end of the cable) through the top opening of the second cable housing assembly 20 and through the attached tubular end segment 58. The cable could continue to be threaded through the tubular arm segment(s) 56 and the rigid tubular base 46 where it exits below the base. The first bead stop is then fitted into a cable retention sleeve 66. The cable retention sleeve is then seated within the bore 62 of the elongate body 60 of the first cable housing assembly. The cam lock shaft 64 (with the cam lever 65 attached) is then inserted through the openings in the elongate body 60 and the retention sleeve 66 aligned therein. A retention component (lock ring) is typically used to hold the cam lock shaft in place.

After installation of the first cable end into the first cable housing assembly has been completed, the cable tensioning nut 70 can be adjusted to take up unnecessary slack in the cable. This nut on the threaded tube 68 positions the second cable housing 20 relative to the tubular end segment 58. After adjustment, there will still be some cable slack left. This is taken up when the cam lever is eventually activated to hold the cable and tubular arm in the position desired by the user.

The pivot support piece 72 can now be placed over the second cable housing. The ring seats 78, 80 of the forks 74 of the pivot support piece are placed in alignment with and on the outside of the radial protrusions 71 of the second cable housing. Once aligned, the rectangular pin shaft 82 can be inserted through the aligned components of the pivot support piece and second cable housing until the first end of the pin shaft 84 exits the pivot support piece and the second end of the support shaft with the external teeth 84 are seated and mated with the internal teeth 98 of the second ring seat 80. The spring 81 and plunger ring 83 can be positioned and secured in place with a screw 85 threaded into the end of the rectangular pin shaft.

The mounting/pivot plate 86 can now be positioned over the annual post 76 of the pivot support piece 72. The pressure cup 90 is positioned within the pivot support piece and a threaded bolt 92 inserted until it exits the bottom of the annular post section 72. A nut 94 is threaded onto the bolt for securing the components in position. The mounting posts 88 of the pivot mounting plate provide the alignment and securing components for mating with the openings in the base 96 of the attachable device 24

The mounting plate can be secured to the waist belt by any acceptable means. The illustrations show the plate riveted to the waist belt at the side support section 28. Similarly the first cable housing assembly can be secured to the support plate by any acceptable means also. An embodiment of the invention could actually have a side support section and the mounting plate integrated as one piece. In that embodiment, the side support section would also serve the function of a mounting plate.

Figure 16:
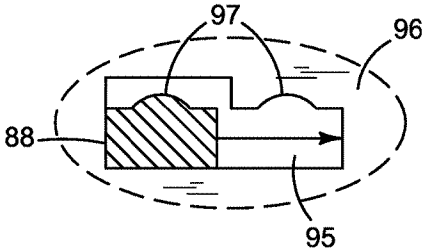
Figure 17:
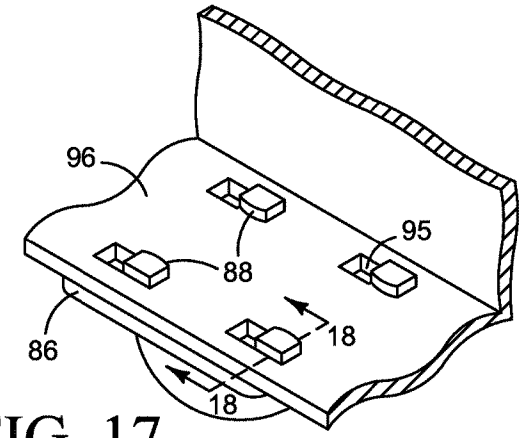
Figure 15:
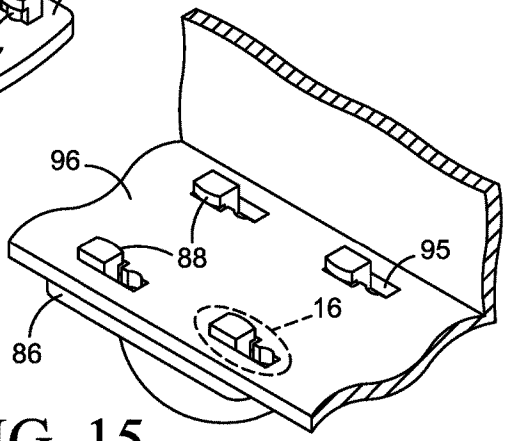
Figure 14:
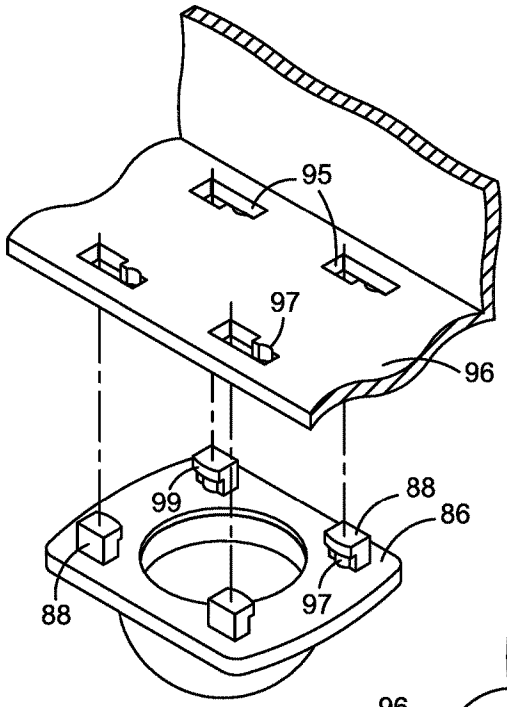

The device 24 to be supported needs to be attached to (or have as a component) a base 96 with openings that align with the mounting posts 88 of the pivot mounting plate. Suitable devices are too numerous to list but include stands, cup or beverage holders, music stands, portable electronic devices, etc. The mounting of the base 96 to the pivot mounting plate utilizing the mounting posts is illustrated in FIGS. 14-18. The base 96 is aligned over the posts and with the flat surfaces of the two components touching, the base (and any attached device) is slid toward one side to secure the base and pivot mounting plate in the proper position as seen in FIGS. 15 and 16. The base is slid back to the original position to disengage the two components.

Figure 10:
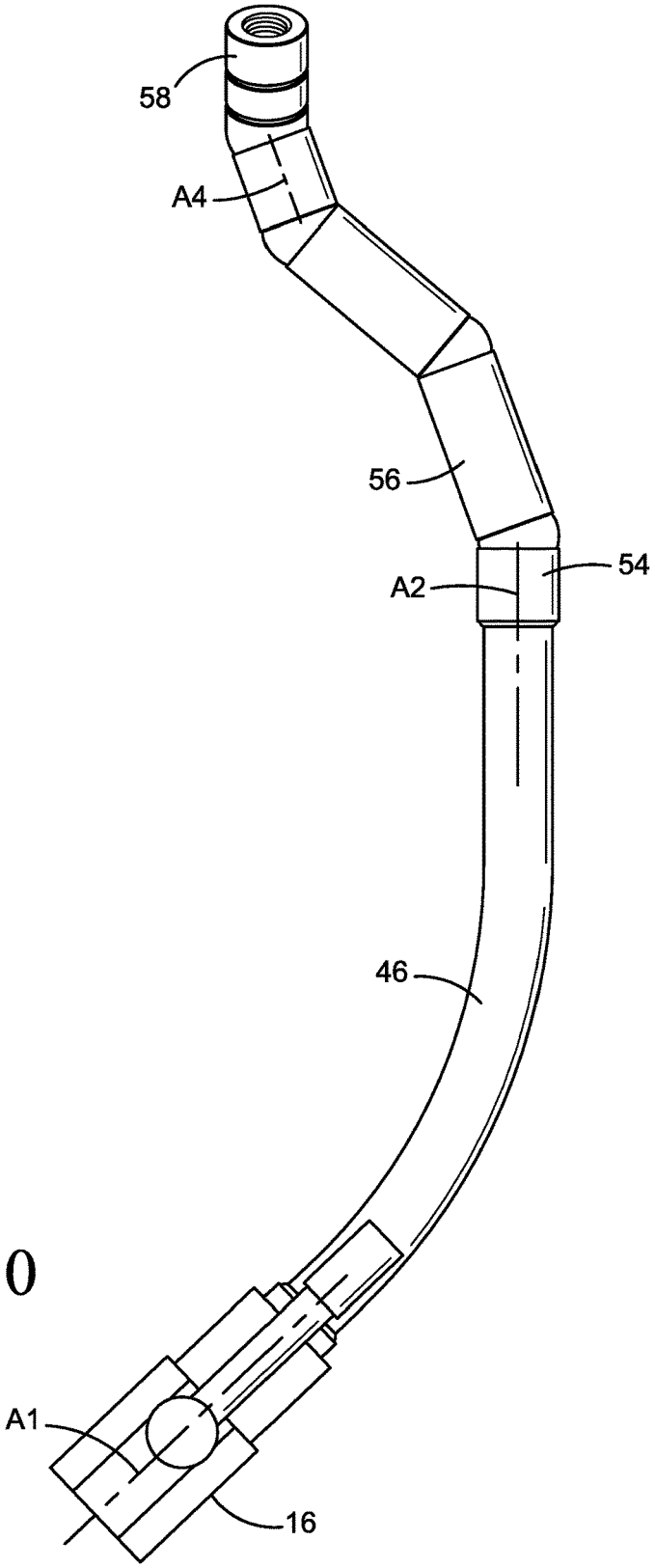
FIG. 10 is an elevation view showing adjustable tubular arm sections in one orientation.
Figure 11:
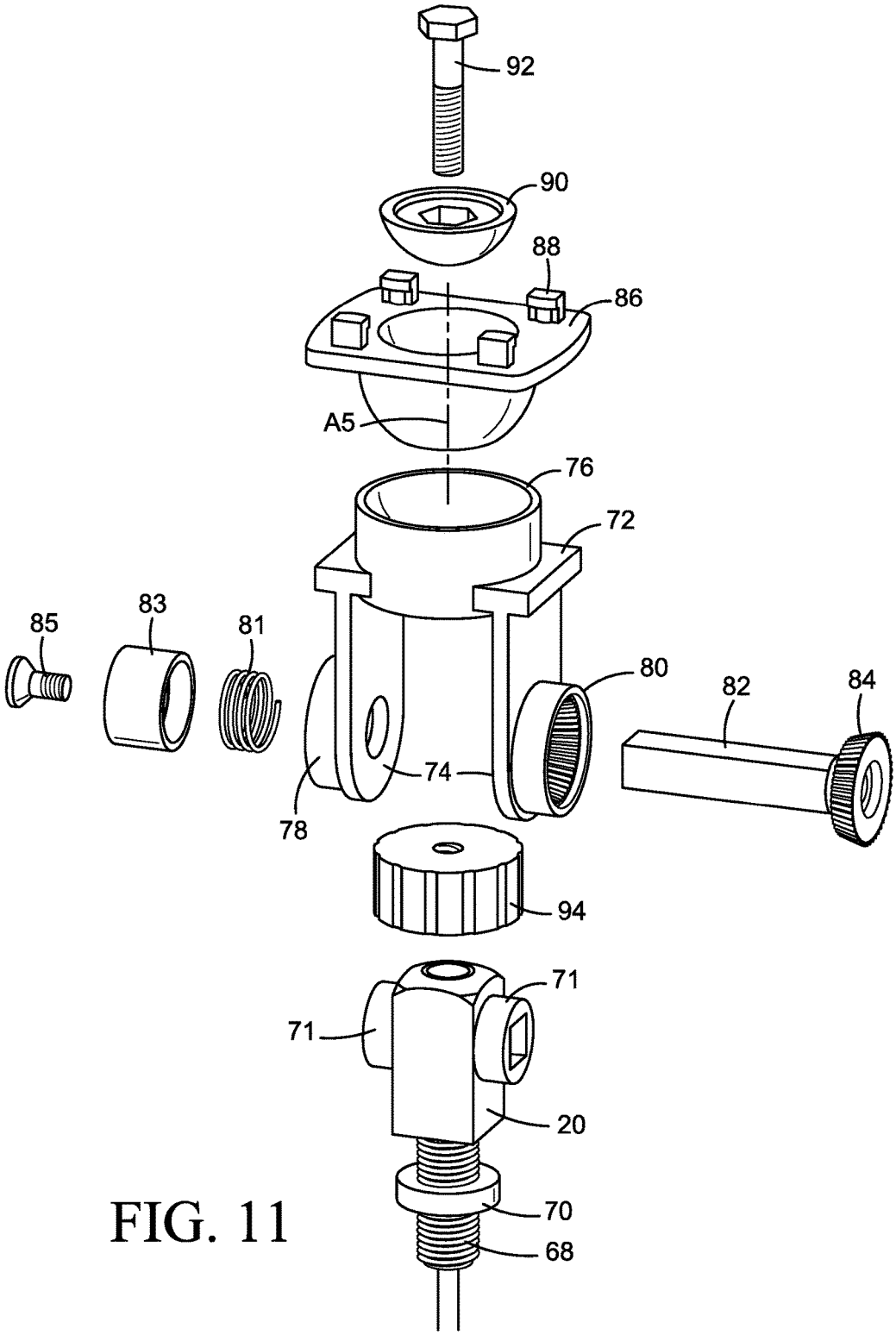
FIG. 11 is an exploded perspective view showing elements of the pivot support assembly and the second cable housing assembly.

The assembled apparatus has several degrees of freedom to allow for varied positioning of the attached device 24. The rigid tubular base 46 can be rotated 360 degrees about axis A1. Axis A1 is coincident with the center of the elongate body 60 of the first cable housing assembly (FIG. 1). Each tubular arm segment (56 for example) can be rotated approximately 30 degrees off the axis coincident with the adjacent tubular arm component. Tubular arm segment 56 shown in FIG. 10 can be rotated about axis A2 which is the axis that is coincident with the axis of the straight section of the rigid tubular base 46. The tubular end segment 58 can also be rotated approximately 30 degrees off of axis A4, the axis coincident with center of the adjacent tubular arm component as shown in FIG. 10.

Figure 12:
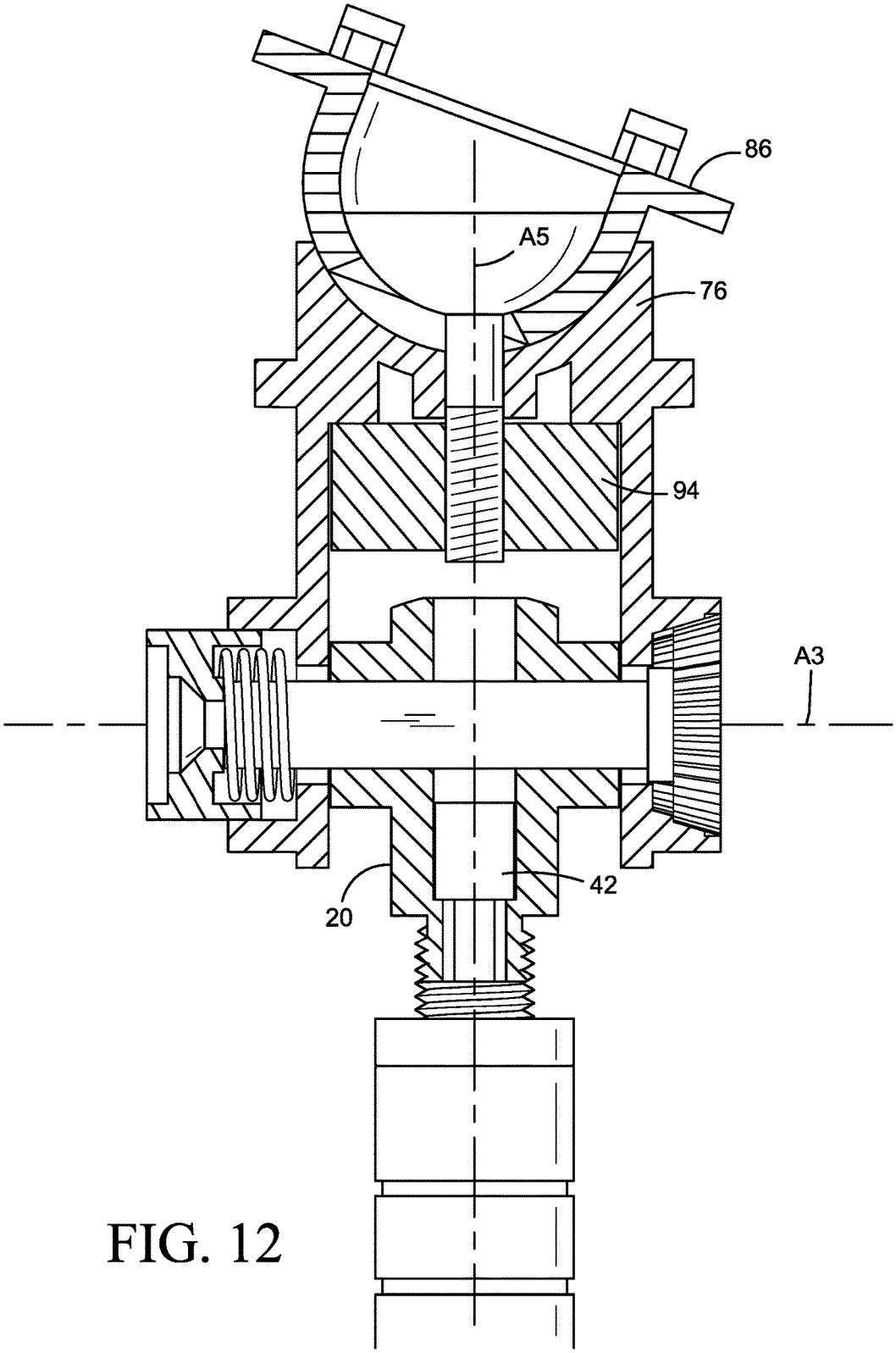
FIG. 12 is an elevation view showing elements of the pivot support assembly, the second cable housing assembly and the sprocket mechanism in engaged position.
Figure 13:
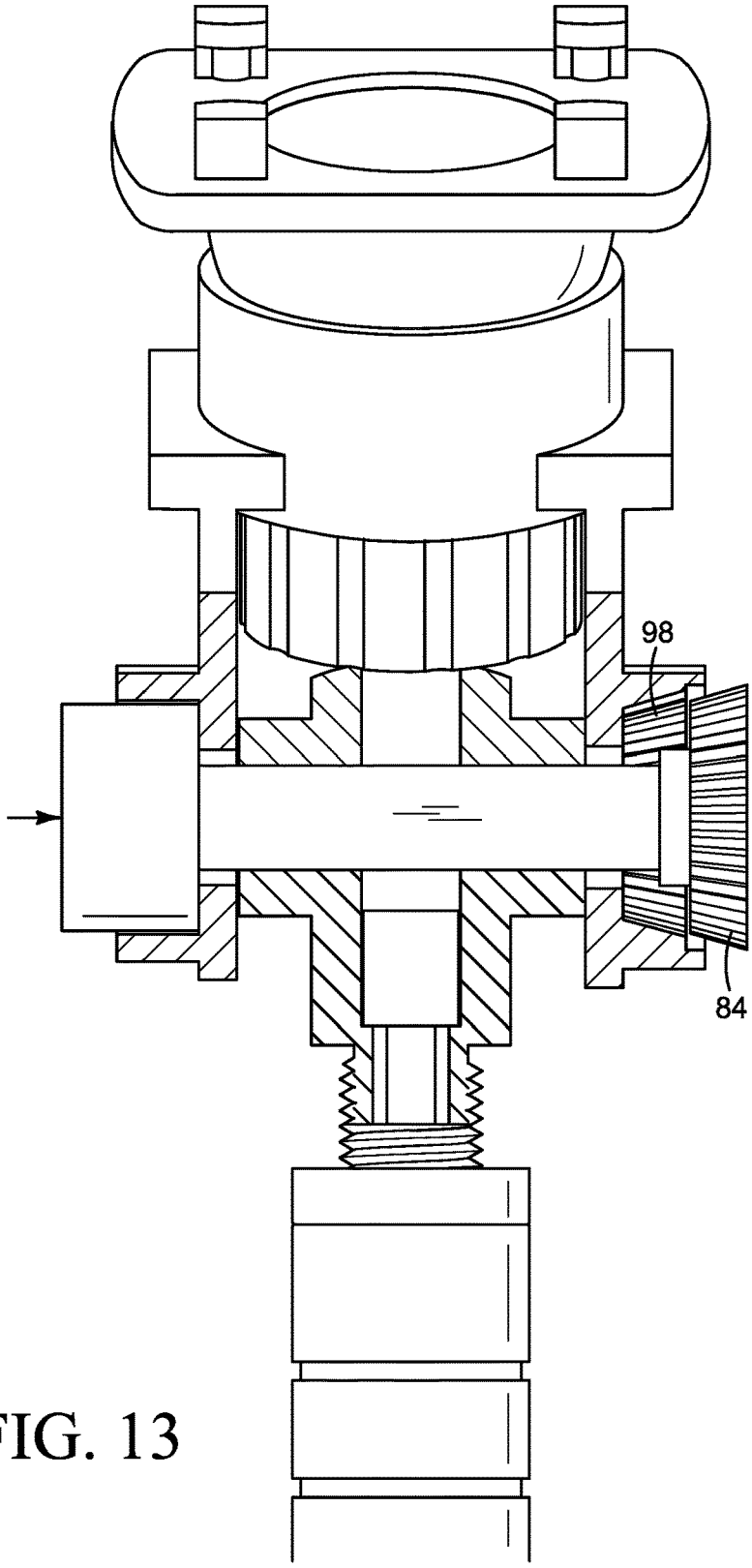
FIG. 13 is an elevation view showing a section of the adjustment means of the pivot support assembly, specifically the sprocket mechanism in disengaged position.

The pivot support assembly 22 can be rotated approximately 300 degrees around axis A3 (FIG. 12), the axis coincident with the center of the rectangular pin shaft 82. In addition, the device 24 can be further rotated approximately 30 degrees about axis A5 (FIG. 12), the axis coincident with the center of the annular post 76 of the pivot support piece 22.

Figure 9:
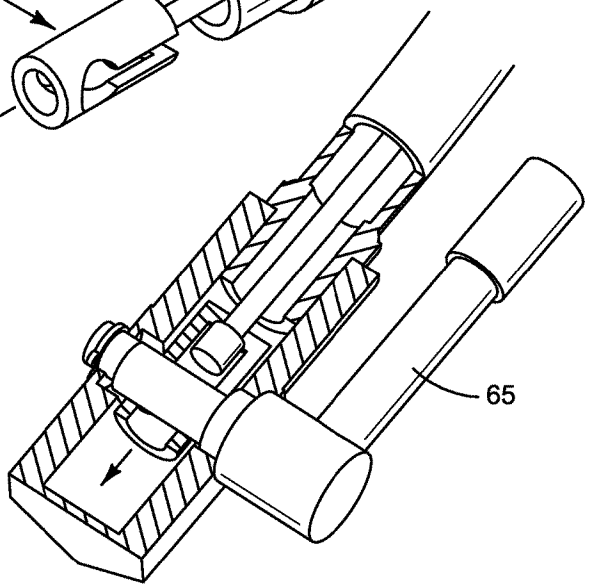
FIG. 9 is a perspective showing the cam tensioner in cable-tensioned position.
Figure 8:
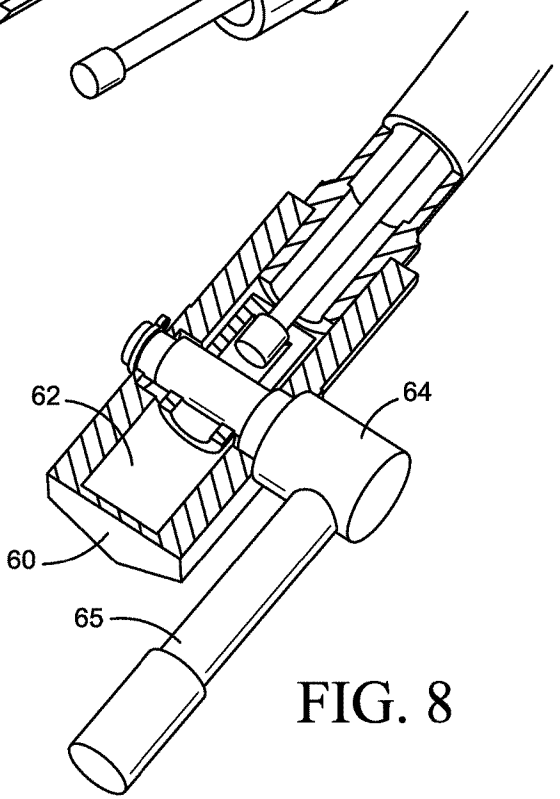
FIG. 8 is a perspective showing the cable retention sleeve inserted into the body of the first cable housing with the cam tensioner lever in the slack position.

To begin to place the apparatus for proper usage, the rigid tubular base 46 would be rotated to achieve the desired position and the lever 65 would be moved from the unlocked position (FIG. 8) to the locked position (FIG. 9). The movement of the lever would move the cam shaft 64 and cause the cable 36 to be taut, thus fixing the rigid tubular base 46, the tubular arm components, and any device attached thereto, if applicable, in their relative positions. The tubular arm segments that are rotatable can be adjusted manually and the tautness of the cable will keep them in their newly adjusted position. It is possible to release the cable tension slightly via the cam lock lever and adjust the rigid tubular base and/or the tubular arm segments in the desired positions before tensioning the cable again.

The pivot support piece 72 (and any attachments thereto) can be rotated about the rectangular shaft axis by depressing the head of the screw 85 and compressing the spring 81. This will push the rectangular pin out from the second ring seat 80 and disengage the external gear teeth 84 from the internal gear teeth 98 thus allowing the pivot support piece to rotate.

The pivot mounting plate 86 can be further rotated by loosening the adjusting nut 94 and rotating the pivot mounting plate into the proper position. Tightening the adjusting nut 94 will then secure the pivot mounting plate in the desired position.

Figure 18:
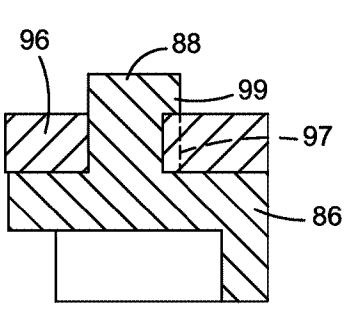
FIGS. 14-18 demonstrate a quick-connect assembly of base 96 of device 24 to mounting plate 86.

FIGS. 14-18 demonstrate a quick-connect assembly of base 96 of device 24 to mounting plate 86. The mounting posts 88 of mounting plate 86 as aligned with corresponding slots in base 96. The base can be a separate component or the base of the device to be attached. The mounting plate 86 and base 96 are shown partially assembled in FIG. 15. FIG. 16 shows a detail section plan view taken from FIG. 15, without the hook portion of post 88, showing the interlocking detent features of a post 88 and a slot in base 96. The mounting plate 86 and base 96 are shown fully assembled in FIG. 17. FIG. 18 is an elevation section view, taken from FIG. 16, showing post 88 detachably engaged with plate 86.

GLOSSARY

Cable: A portion of metal, composite or suitable material having a length and a cross-sectional area. The material properties of the cable must provide strength and durability and not be subject to excessive linear deformation (such as stretching). A cable will typically have a length and a diameter but it is feasible that a cable could have a length and not a diameter, such as in a rectangular cable.

Rigid Side Support: The waist belt shown and described herein includes a side support section that conforms to the side hip or waist area of a user and is rigid enough to counteract the forces of the remaining components of the device mounting apparatus (and device) attached thereto. The rigid side support can have a rigid mounting plate attached thereto or have a mounting plate incorporated into the rigid side support.

Tubular base: The tubular base segment of the tubular arm is rigid and has a curved section and a straight section. Any suitable material can be used to provide the tubular base with the required rigidity.

CONCLUSIONS, OTHER EMBODIMENTS, AND SCOPE OF INVENTION

The illustrations show embodiments of the invention utilized to carry out the intended purpose. However there are modifications that fall within the scope of the invention.

As disclosed, the side support section of the waist belt can be rigid so that the first cable housing assembly can be mounted directly thereto. In another embodiment a separate mounting plate can be utilized between the side support section of the waist belt and the first cable housing assembly.

The tubular base segment of the tubular arm is rigid and has a curved section and a straight section. The rigidity and configuration of the tubular base provide this vital component with the properties necessary to allow the apparatus to maintain its position when the apparatus is deployed for use or positioned on the user in a stored position. Any suitable material can be used to provide the tubular base with the required rigidity to operate effectively. The rigidity of the tubular base is also essential to provide the support necessary to allow the cable to be tightened to hold the apparatus and device in position.

Embodiments of the invention provide at least three degrees of rotational freedom of the device mounting assembly and any device attached thereto. The rigid tubular base 46 can be rotated 360 degrees about axis A1. Tubular arm segment 56 can be rotated approximately 30 degrees off of axis A2. The pivot support assembly 22 can be rotated approximately 300 degrees about axis A3. This allows great flexibility of the position of a device that is attached. For example, an electronic device with a screen can be positioned vertically to face the user and then easily adjusted (rotated approximately 90 to 150 degrees) about axis A3 to face towards and provide access to another for review and a signature, for example.

These three degrees of freedom provide great maneuverability of the device mounting plate 86 and any device attached thereto. An important feature of these embodiments is the ability to store the apparatus in a fixed, solid position against the user's chest or to the side when not in use. In other words, the use of the cam lever and cable tensioning allows the apparatus to have solid structural support along the whole length of the cable.

Another axis of rotation A4 is utilized when a tubular end segment 58 has a rounded end to allow it to rotate (approximately 30 degrees) about A4. The addition of tubular arm segments can provide further axes of rotation if desired or required.

A final axis of rotation A5 runs through the center of the annular post 76 of the pivot support piece 72. An electronic device (or a paper form) can also be rotated approximately 180 degrees about axis A5 to provide access to another person (facing the user, for example).

In one embodiment detailed herein, a cable tensioning nut 70 is utilized to take up unnecessary slack in the cable. In another embodiment the cable tensioning feature in the second cable housing assembly is eliminated. In this case, the cable would be sized to the correct length so that only the cam lock lever would be needed to adjust the position of the cable and allow the tubular arm components to be locked into position.

The above description presents the best mode contemplated in carrying out the invention. However, it is susceptible to modifications and alternate constructions from the embodiments shown in the drawings and accompanying description. Consequently it is not intended that the invention be limited to the particular embodiments disclosed. On the contrary, the invention is intended to cover all modifications, sizes and alternate constructions falling within the spirit and scope of embodiments of the invention.

What is claimed is:

1. A hands-free device mounting apparatus comprising:

a flexible waist belt worn by a user, the waist belt having an overall length sufficient to wrap about the waist of a user, the waist belt having a rear support portion, at least one rigid side support portion, and two end portions, the rear support portion encompassing a length of the center of the belt up to the side portions, the rear support portion taller than the end portions;

a cable having a length and a diameter, the cable including a first cable stop bead fixed at one end and a second cable stop bead having a diameter larger than the first cable stop bead fixed to the remaining cable end;

a first cable housing assembly fixed to the waist belt, the first cable housing assembly having an elongate body with a closed end and a central bore opening placed longitudinally therein, the bore opening accepting a cable retention sleeve with the first cable stop bead inserted therein, the first cable housing assembly further having a cam lock adjustment lever mounted orthogonally there through, the cam lock adjustment lever interfacing with the cable retention sleeve to adjust the position of the cable stop bead within the bore opening;

a rigid, rotatable tubular base segment seated into the central bore opening of the first cable housing body, the base segment having a flange ring fixed proximal to one end and a flared section formed proximal to the other end, and a curved section that culminates into a straight section nearer to the flared end, the base segment seated onto the central bore opening, the cable extending through the tubular base segment, the first cable housing providing a first axis (A1) of rotation through a longitudinal center thereof, the first axis about which the tubular base segment has rotational freedom;

at least one tubular arm segment having a half round end formed or otherwise attached at one end with a central cable opening placed there through and a chamfered opposing end, the tubular arm segment providing a second axis (A2) of rotation through the straight section of the tubular base segment, the second axis about which at least one tubular arm segment has rotational freedom;

a second cable housing, the second cable housing having an elongate body and a keyway extending orthogonally through the second cable housing body;

a pivot support piece mechanically attached over the second cable housing, the pivot support piece having a left and a right fork oriented in opposing and aligned configuration, the forks fixed at one end to an outside surface of an annular post, the forks sharing an opening placed orthogonally through free ends of the forks, the pivot support piece providing a third axis (A3) of rotation through the opening shared by the forks of the pivot support piece and through the second cable housing body, the third axis about which the pivot support piece has rotational freedom; and a device mounting plate assembly.

2. The device mounting apparatus of claim 1 further comprising:

a tubular end connector, the tubular end connector located between the at least one tubular arm segment and the second cable housing, the tubular end connector having a central cable opening placed there through and a threaded cap segment formed or otherwise attached to one end, the threads formed on an inside diameter of the cap segment; and the second cable housing further including a threaded opening placed longitudinally therein the elongate body and a male threaded tube seated therein and extending out and below the second cable housing at a first end, and a cable tensioning nut threaded there over.

3. The device mounting apparatus of claim 1, further including a rigid apparatus mounting plate fastened to the waist belt on the at least one side support portion, the mounting plate having a length, a width, and a curvature conforming at least partly to the curvature of a user's hip.

4. The device mounting apparatus of claim 1, further including an attachment mechanism for connecting the end portions of the waist belt together to form a front portion of the waist belt, the front portion oriented opposite of the rear support portion of the belt when worn.

5. The device mounting apparatus of claim 2 further including a half round end formed or otherwise attached at one end of the tubular end connector, the at least one tubular arm segment providing a fourth axis (A4) of rotation through the longitudinal center thereof, the fourth axis about which the tubular end connector has rotational freedom.

6. The device mounting apparatus of claim 5, wherein the annular post of the pivot support piece has a concave upper surface functioning as a joint for a ball joint; and the device mounting plate assembly has a length and width and a hollow downward-facing ball seat interface with an elongate slot opening placed there through for accepting a central mounting screw, the ball seat interface conforming to the upper concave surface of the annular post of the pivot support piece, the mounting plate assembly further including a pattern of two or more slide lock mounting posts extending upward from a plate surface that align with mated openings on a device support plate to which a device may be attached to, the mounting plate assembly further including a pressure cup having a downward facing radial surface seated within and against the ball seat interface, the central mounting screw passing there through and held in place by a thumb nut threaded thereon, the device mounting assembly capable of being pivoted about an axis (A5) through a longitudinal center of the annular post.

7. The device mounting apparatus of claim 1 further including:

a first ring seat fixed to an outside surface of one fork and a second ring seat fixed to an outside surface of the opposing fork, the ring seats aligned with the shared opening, the second seat having a chamfered inside surface area having multiple grooves oriented in parallelism and placed adjacently and at equal spacing in a radial groove pattern around at least a portion of an inside surface of the second ring seat;

a pivot lock pin assembly including an elongate pivot lock pin inserted through the opening in the forks and through the keyway in the second cable housing, the pivot lock pin further including a turn knob disposed at one end thereof, the turn knob chamfered on an interfacing surface and having splines in a matching radial spline pattern interfacing with the radial groove pattern in the second ring seat, the pivot lock pin further including a threaded opening placed centrally in the opposing end thereof, a thumb screw seated against a spring assisted plunger ring and threaded into the threaded opening on the pivot lock pin.

8. The device mounting apparatus of claim 7, wherein the keyway and pivot lock pin are rectangular, triangular, hexagonal, octagonal, or otherwise polygonal.

9. The device mounting apparatus of claim 6 further including:

a first ring seat fixed to an outside surface of one fork and a second ring seat fixed to an outside surface of the opposing fork, the ring seats aligned with the shared opening, the second seat having a chamfered inside surface area having multiple grooves oriented in parallelism and placed adjacently and at equal spacing in a radial groove pattern around at least a portion of the inside surface of the second ring seat;

a pivot lock pin assembly including an elongate pivot lock pin inserted through the opening in the forks and through the keyway in the second cable housing, the pivot lock pin further including a turn knob disposed at one end thereof, the turn knob chamfered on an interfacing surface and having splines in a matching radial spline pattern interfacing with the radial groove pattern in the second ring seat, the pivot lock pin further including a threaded opening placed centrally in the opposing end thereof, a thumb screw seated against a spring assisted plunger ring and threaded into the threaded opening on the pivot lock pin.

10. The device mounting apparatus of claim 9, wherein the keyway and pivot lock pin are rectangular, triangular, hexagonal, octagonal, or otherwise polygonal.

11. The device mounting apparatus of claim 6, further including a rigid apparatus mounting plate fastened to the waist belt on the at least one side support portion, the mounting plate having a length, a width, and a curvature conforming at least partly to the curvature of a user's hip.

12. A method of using the hands-free device mounting apparatus of claim 1 wherein a user may wear the device mounting apparatus about the waist and attach a device to the device mounting plate assembly, and wherein the user may position the device for user interaction therewith according to at least two degrees of freedom relative to a desired angle of presentation of the device and wherein the user may secure a rigid position of the device and tubular arm segments via the cam lock adjustment lever and wherein the mounted device may be further pivoted about the third axis of rotation of the pivot support piece.

* * * * *